US007506761B2

(12) United States Patent
Levy

(10) Patent No.: US 7,506,761 B2
(45) Date of Patent: Mar. 24, 2009

(54) DRUG DISPLAY CARD

(75) Inventor: Gordon Levy, Denver, CO (US)

(73) Assignee: Navajo Manufacturing Company, Inc., Denver, CO (US)

( * ) Notice: Subject to any disclaimer, the term of this patent is extended or adjusted under 35 U.S.C. 154(b) by 435 days.

(21) Appl. No.: 11/360,415

(22) Filed: Feb. 24, 2006

(65) Prior Publication Data

US 2007/0199850 A1 Aug. 30, 2007

(51) Int. Cl.
*B65D 73/00* (2006.01)

(52) U.S. Cl. ..... 206/464; 206/461; 206/470; 206/459.5

(58) Field of Classification Search ..... 206/464, 206/465, 461, 462, 463, 470, 459.5, 528, 206/530, 534
See application file for complete search history.

(56) References Cited

U.S. PATENT DOCUMENTS

| | | | | | |
|---|---|---|---|---|---|
| 2,884,127 | A | * | 4/1959 | Neary | 206/462 |
| 2,956,677 | A | * | 10/1960 | Kavadlo et al. | 206/462 |
| 2,993,590 | A | * | 7/1961 | Denton | 206/469 |
| 3,289,830 | A | * | 12/1966 | Foote | 206/469 |
| 3,358,824 | A | | 12/1967 | Stagnitto | 206/459.5 |
| 3,429,451 | A | * | 2/1969 | Samsing | 211/72 |
| 3,939,979 | A | * | 2/1976 | Neumayer | 206/461 |
| 4,210,246 | A | * | 7/1980 | Kuchenbecker | 206/461 |
| 4,236,636 | A | * | 12/1980 | Kuchenbecker | 206/461 |
| 4,300,682 | A | * | 11/1981 | Kuchenbecker | 206/461 |
| 4,441,739 | A | | 4/1984 | Cluff | 281/16 |
| 4,549,654 | A | * | 10/1985 | Tiesman | 206/486 |
| 5,377,836 | A | * | 1/1995 | Eisenbraun | 206/461 |
| RE35,445 | E | | 2/1997 | Pora | 206/532 |
| 5,791,470 | A | * | 8/1998 | Usui | 206/362.4 |
| 5,984,685 | A | | 11/1999 | Portnoy | 434/262 |
| 6,053,325 | A | | 4/2000 | Yonker | 206/736 |
| 6,666,332 | B1 | | 12/2003 | DeWolf | 206/459.5 |
| 6,902,197 | B2 | | 6/2005 | Vijuk | 283/67 |
| 2004/0188998 | A1 | | 9/2004 | Henthorn | 283/900 |
| 2005/0103677 | A1 | | 5/2005 | Fuchsberger | 206/534 |

* cited by examiner

*Primary Examiner*—David T Fidei
(74) *Attorney, Agent, or Firm*—Jacobson Holman PLLC

(57) ABSTRACT

A fold line separating an upper section from a lower section of a drug display card such that the upper section is folded downwardly to lie parallel to and in contact with the lower portion. The upper portion is interengaged with the lower portion so as to secure the upper portion in place. In addition, both the upper portion and lower portion include a hanging hole which are in alignment with each other to form a single through passage when the upper edge is folded along an upper portion of the lower portion of the card. A double thickness reinforced hanging card is thereby provided.

6 Claims, 7 Drawing Sheets

DRUG DISPLAY CARD

FIELD OF THE INVENTION

The present invention relates to a drug display card having a fold at an upper end of the card and a hanging opening in two overlying portions of the card. The card folds along an upper edge to minimize occupied space of the card on a hanging display.

BACKGROUND OF THE INVENTION

In drug stores, convenience stores, grocery stores or other retailers selling small quantities of non-prescription drugs, a display device is usually used to sell one or two packets of a pain reliever, for example. Small quantities of other medicines or bandages, for example, may be displayed by the display device.

An example of one such display device is shown in FIGS. 1 and 2. In these figures, a display package 10 is supported on a support rod 11. The support rod 11 is mounted on a support or peg board 14. The support includes a plurality of holes 16 through which the rod extends to support a plurality of display packages 10.

As shown in side view in FIG. 2, the display package 10 includes an upper portion 12 and a lower portion 14. The lower portion is secured to the upper portion 12 along a lowermost edge 16. The edge 16 may be a fold line or a perforation line to facilitate the folding of the bottom portion 14 onto the upper portion 12 along a lower portion 18 of the upper portion by movement of portion 14 in a direction of arrow 20. The lower portion 14 includes a tab 22 which is inserted into and secured within upper portion 12 so that the lower portion 14 overlies the lower portion 18 of upper portion 12.

As shown in FIG. 1, tab 22 is intended to fit within a semi-circular shaped opening 24 located in upper portion 12. Semi-circular shaped opening 24 is a perforated score line extending from straight segments of perforated or score line 26. The tab 22 is intended to fit within and be held in a recess formed when semi-circular perforation 24 and straight line perforation 26 are pushed into an interior of the transparent blister pack 28 which holds medicine, etc. on the front of upper portion 12 of the display package 10.

It has been found that, over time, the lower portion 14, due to gravity and the bias forces formed at fold line 16, is forced to separate and move away from the upper portion 12 of the display package 10. Therefore, over time, as shown in FIG. 1, the bottom portions 14 form a V-shape with the upper portions 12 and move away from the upper portion 12 in a direction opposite to that of arrow 20.

The separation of the lower portion 14 from the upper portion 12 serves to space out the plurality of display packages 10 along the support rod 11, thereby limiting the amount of product which can be hung on support rod 11. This is particularly true as product is removed from support rod 11. A decreased amount of product on the hang rod allows the lower portion 14 to push off against the next successive display package 10 and force the plurality of display packages to travel forward along the support rod 11. This is caused by the natural tendency of the lower portions 14 to separate from the upper portions 12.

With the products moving forward along the support rod 11, an appearance is provided to a store clerk that the support rod 11 is full without the store clerk appreciating that their inventory has dwindled and that it is necessary to reorder additional product. Therefore, when the few remaining products on the support rod 11 are sold, the depletion of inventory would come as a surprise to the store clerk and result in a lag time prior to restocking and making product again available to the customer for purchase.

Accordingly, there is a need to maintain an accurate assessment of the quantity of inventory hung on a display rod while maximizing available storage on a display rod.

In addition, the single hanging hole 30 of the display package 10 provides for limited strength in securing display packages on the support rod 11. Once the single hanging hole 30 is torn by prospective customers removing, examining and returning product to the support rod, special care is required by the store clerk to resupport the display package on the support rod 11.

Accordingly, there is a need to reinforce display packages hanging on a support rod.

SUMMARY OF THE INVENTION

Accordingly, it is an object of the present invention to overcome the deficiencies of the prior art.

The present invention overcomes the deficiencies of the prior art by forming a fold line separating an upper section from a lower section of a drug display card such that the upper section is folded downwardly to lie parallel to and in contact with the lower portion. The upper portion is interengaged with the lower portion so as to secure the upper portion in place.

In addition, both the upper portion and lower portion include a hanging hole which are in alignment with each other to form a single through passage when the upper edge is folded along an upper portion of the lower portion of the card. A double thickness reinforced hanging card is thereby provided.

Accordingly, it is another object of the present invention to provide a drug display card having an upper portion extending downwardly from an uppermost edge of a lower portion of the card.

It is yet another object of the present invention to provide a drug display card having an upper portion extending downwardly from an uppermost edge of a lower portion of the card with the upper section and lower section of the card each having a hanging hole in alignment with each other when the upper section is folded down along the rear of the lower section.

It is still yet another object of the present invention to provide a drug display card having an upper portion extending downwardly from an uppermost edge of a lower portion of the card with the upper section and lower section of the card each having a hanging hole in alignment with each other when the upper section is folded down along the rear of the lower section with the upper section having a tongue for engaging in a slot of the lower section to lock the upper section parallel to and overlying the lower section for a secure connection of the upper section to the lower section.

These and other objects of the invention, as well as many of the intended advantages thereof, will become more readily apparent when reference is made to the following description taken in conjunction with the accompanying drawings.

BRIEF DESCRIPTION OF THE DRAWINGS

The following drawings illustrate examples of various components of the drug display card disclosed herein, and are for illustrative purposes only. Other embodiments that are substantially similar can use other components that have a different appearance.

DETAILED DESCRIPTION OF THE PREFERRED EMBODIMENTS

Figure 1:
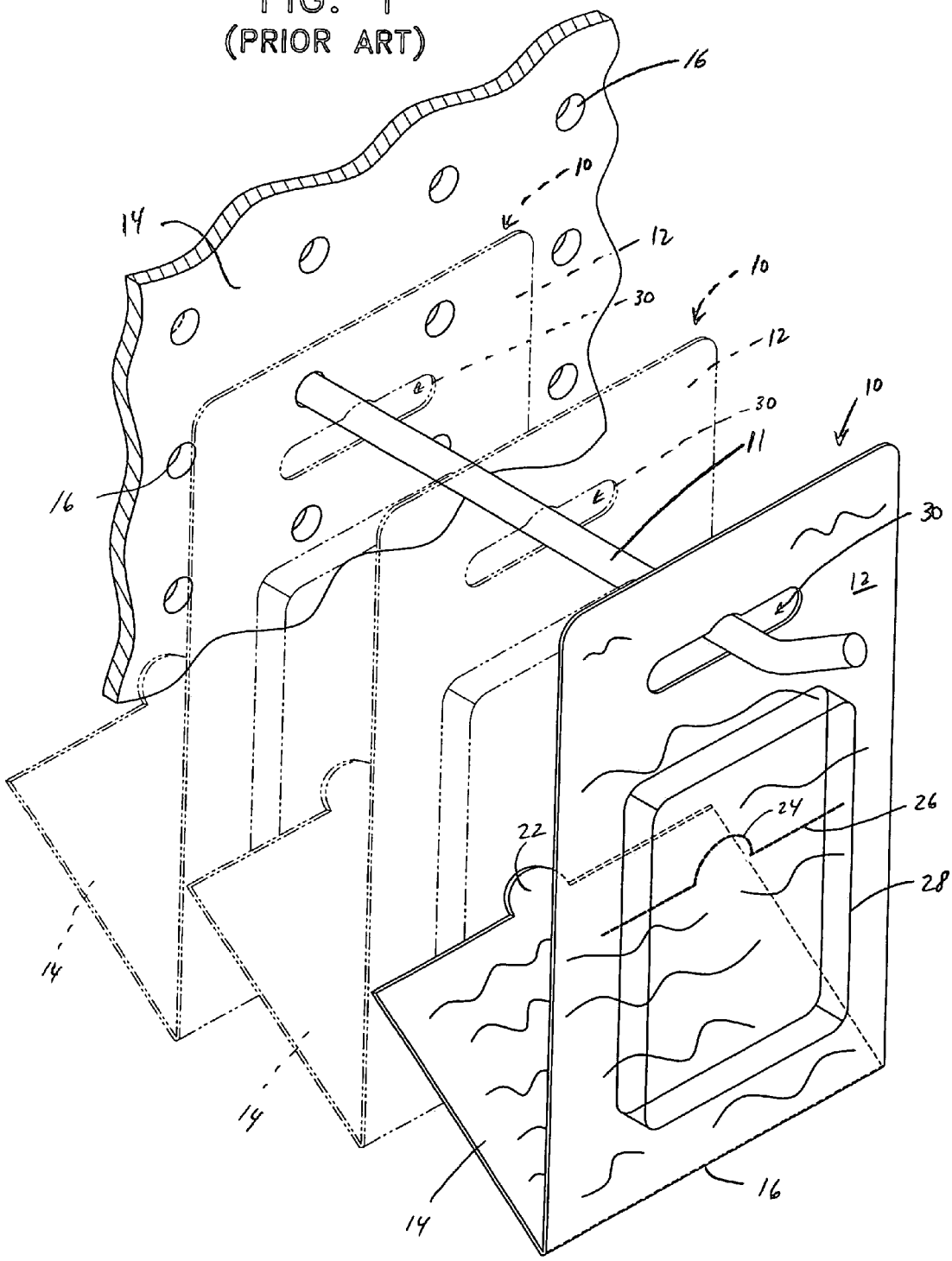
FIG. 1 (PRIOR ART)
FIG. 1 is a perspective view of a display device known in the prior art.
Figure 2:
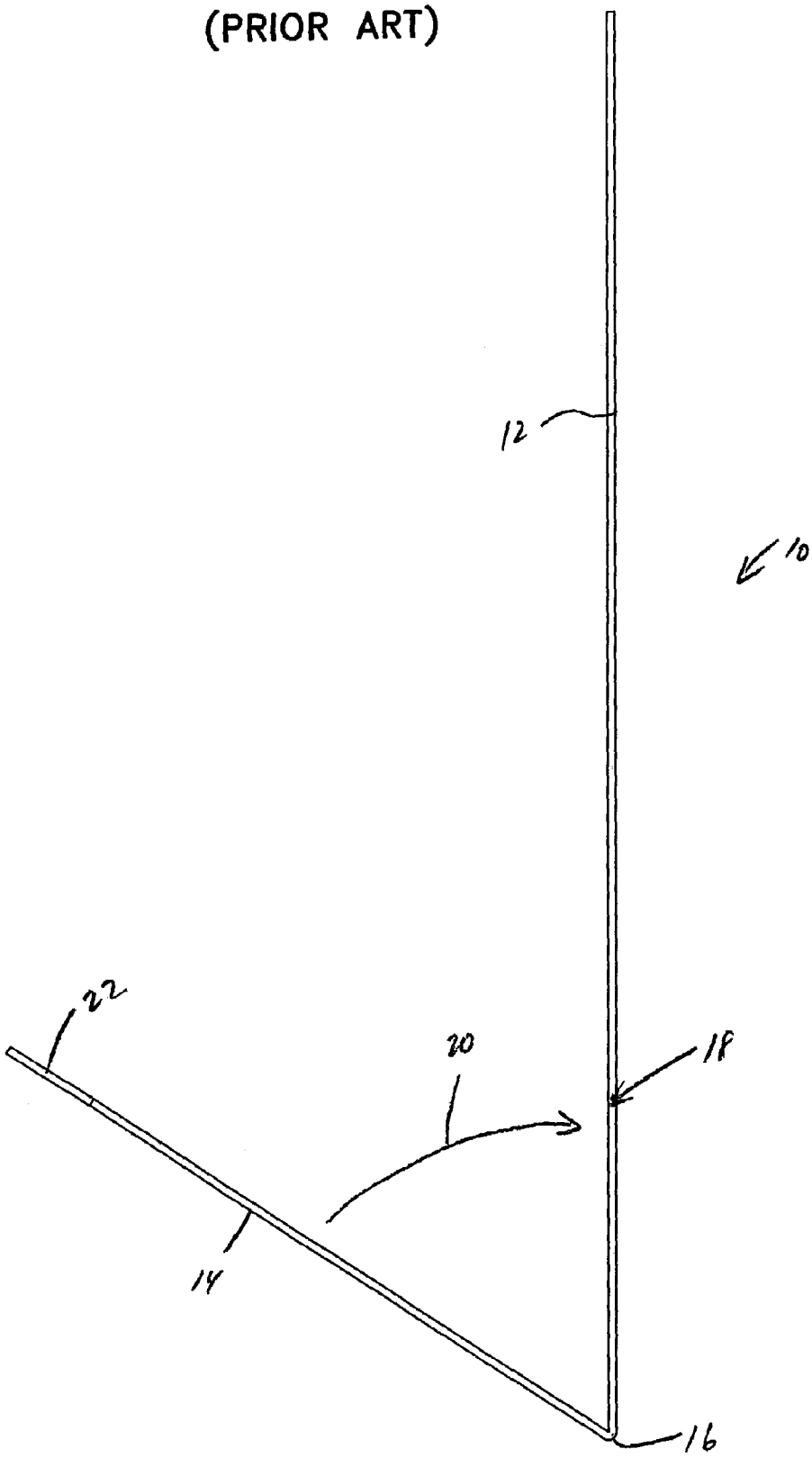
FIG. 2 (PRIOR ART)
FIG. 2 is a side view of the display device shown in FIG. 1.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 3:
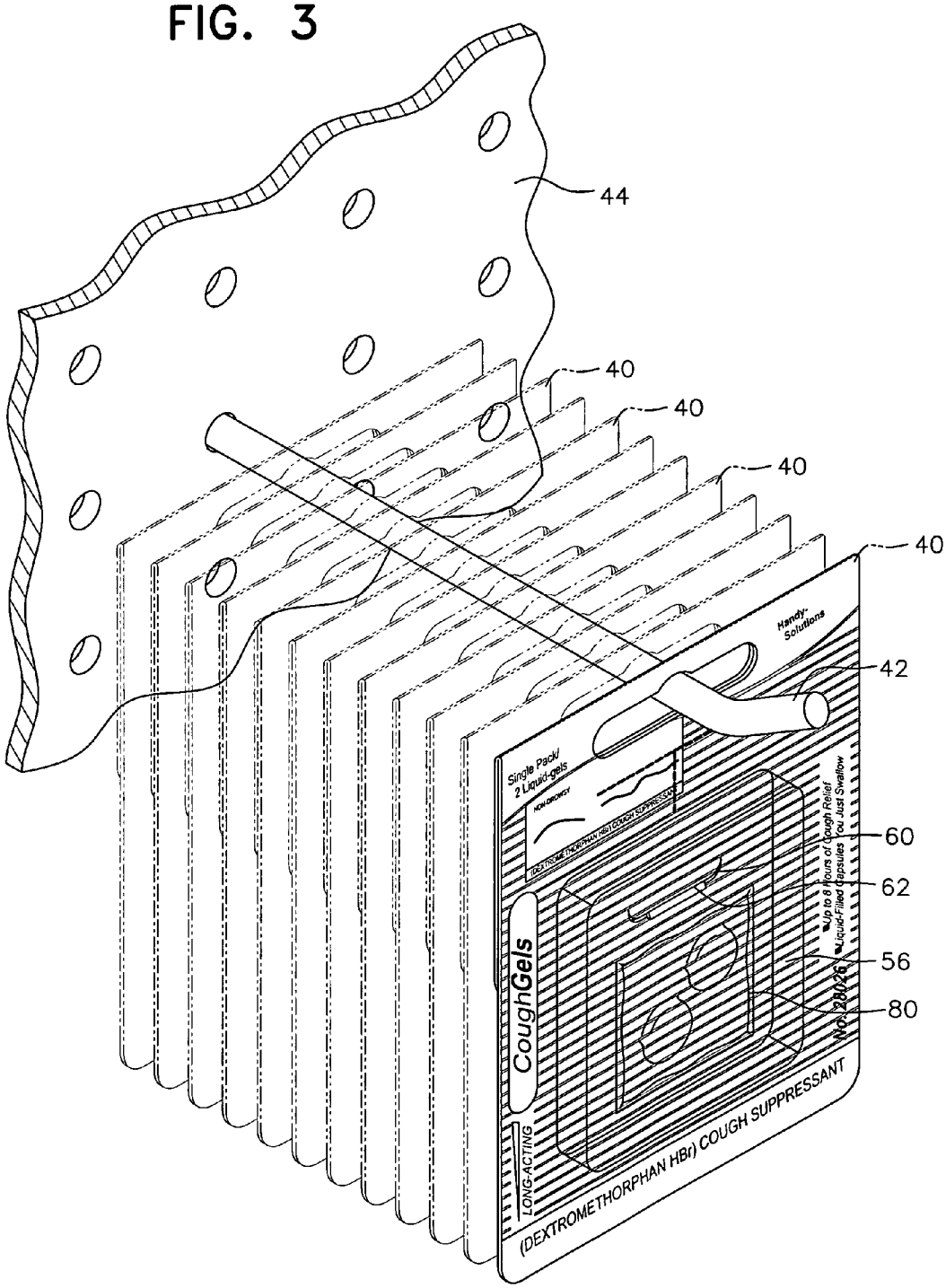
FIG. 3 is a perspective view of a plurality of drug display cards mounted on a support rod.
Figure 6:
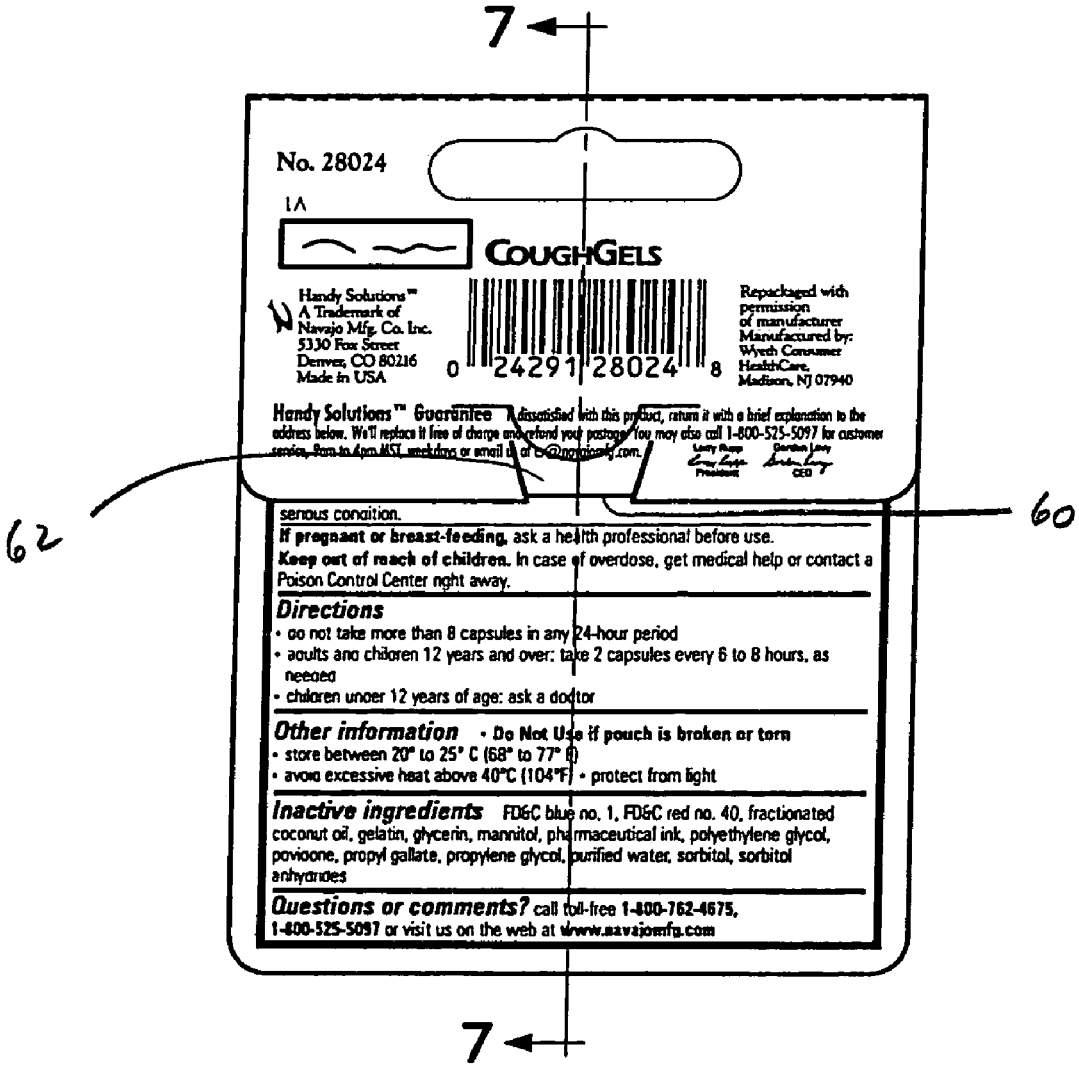
FIG. 6 is a rear view of the drug display card of the present invention with an upper portion of the card folded onto a lower portion of the card.
Figure 7:
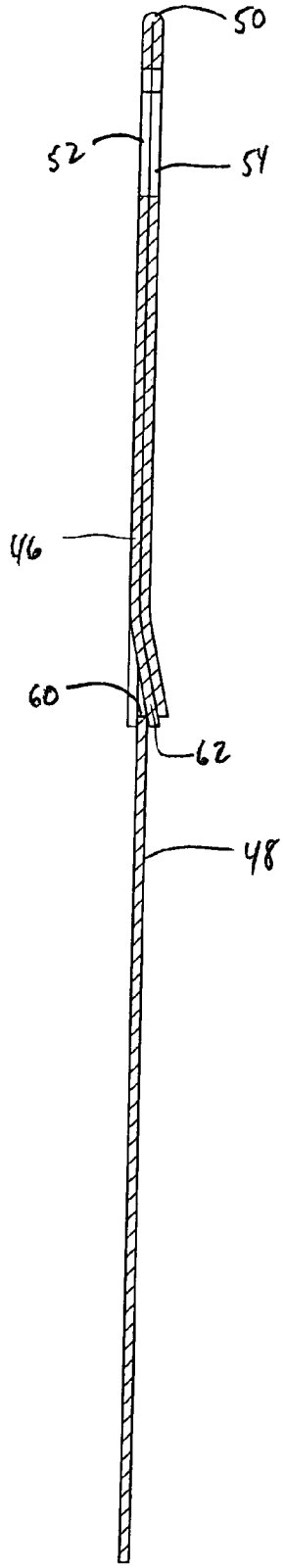
FIG. 7 is an enlarged side view of the drug display card of the present invention as taken along line 7-7 of FIG. 6.

With reference to the drawings, in general, and FIGS. 3, 6 and 7, in particular, a drug display card embodying the teachings of the subject intention is generally designated as 40. With reference to its orientation in FIG. 3, a plurality of drug display cards 40 are shown. The cards extend vertically from a support rod 42. One end of the support rod is mounted on a peg board or other support 44.

Figure 4:
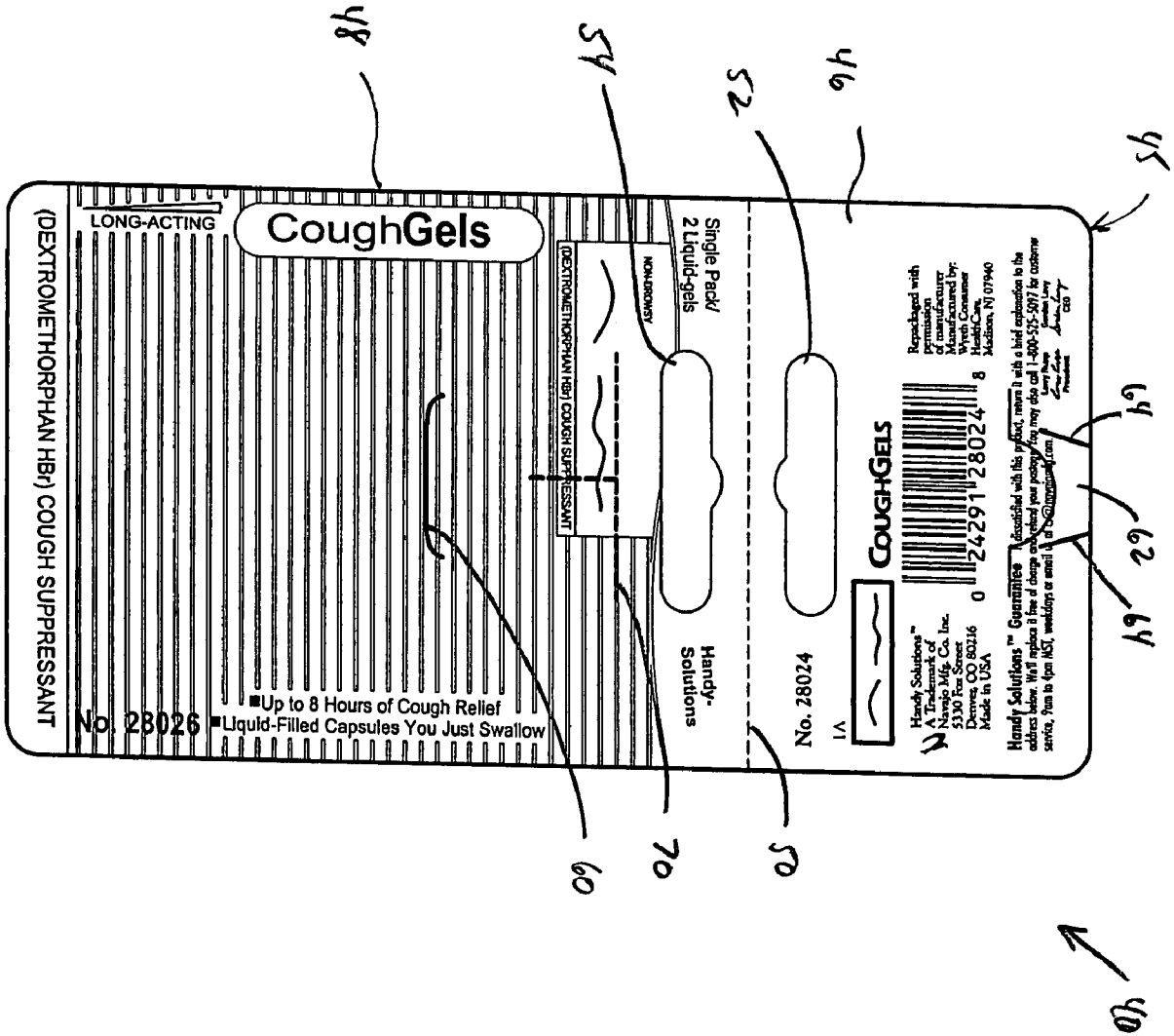
FIG. 4 is a front view of a drug display card of the present invention in an unfolded position.
Figure 5:
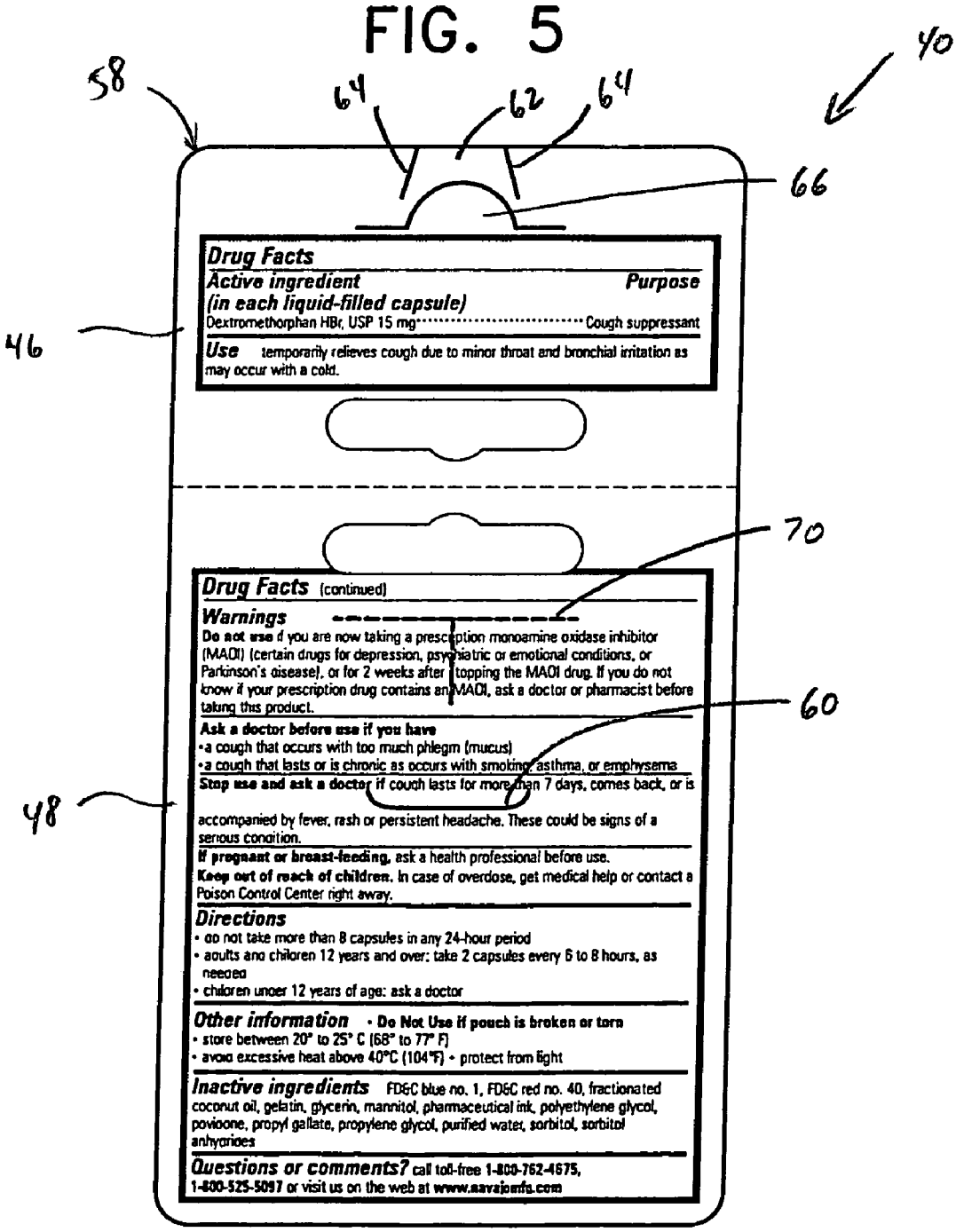
FIG. 5 is a rear view of the drug display card of the present invention shown in an unfolded condition.

As shown in FIGS. 4 and 5, a drug display card 40 includes an upper portion 46 and a lower portion 48. A perforated score or fold line 50 separates the upper portion 46 from the lower portion 48. A length of the upper portion 46 is approximately equal to one half of the length of the lower portion 48. The upper portion 46 includes an elongated hanging hole 52 whereas the lower portion 48 includes an elongated hanging hole 54 of approximately equal dimensions of that of hanging hole 52.

The lower portion 48 includes indicia identifying the name of the product as well as other descriptions and trade name identifiers. The plastic blister 56 as shown in FIG. 3 is omitted from FIG. 4 for purposes of clarity. The plastic blister 56 contains the drug product 80 to be displayed on the card 40.

The upper portion 46 also includes indicia such as a bar code, manufacturer identifiers, guarantees, product name, and other information.

The positioning of the hanging holes 52 and 54 in the upper section 52 and lower section 58 respectively, are positioned so that when the upper portion 46 is folded downwardly along the rear side of the lower portion 48, the two hanging holes 52, 54 are in alignment. Therefore, as shown in FIG. 3, the support rod 42 passes through both of the hanging holes 52, 54 for a reinforced hanging of the card 40 by a card of double thickness as compared to a single thickness in the prior art.

The rear face 58 of the card 40 as shown in FIG. 5, includes indicia on both of the upper section 46 and lower section 48. The indicia may include required drug facts that are mandated to be provided with the sale of certain medicines.

In addition, as seen from front side 45 and rear side 58 of the card 40, the lower portion 48 includes a slot 60 for receipt of a tongue 62 of upper section 46 formed by cut lines 64. Tongue 62 is free at the upper edge of the upper portion 46 so that when the upper portion is folded along the lower portion, as shown in FIG. 6, the tongue 62 projects into slot 60 to secure the upper portion 46 to the lower portion 48. Due to the tendency of both portions 46, 48 to hang downwardly, there is an increased force to maintain the upper portion 46 parallel to and engaged with lower portion 48. Therefore, as seen in FIG. 3, a plurality of cards 40 are located on a support rod without a tendency to push one card against another and move the stack of cards toward the free end of the support rod 42.

The tongue 62 is shown in an alternative arrangement as tongue 66 formed in a semi-circular shape to be aligned with an associated slot positioned in the lower portion so as to receive tongue 66 and thereby similarly interconnect upper and lower portions 46, 48 as was done by tongue 62. T-shaped perforated lines 70 are shown so as to gain access into the interior of blister pack 56.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A display card for displaying product on a hanging support, said display card comprising:

an upper portion, a lower portion including a plastic blister located on a front surface of said lower portion, said plastic blister including medicine therein, a separation line located between said upper portion and said lower portion, said upper portion being pivotally mounted on said lower portion about said separation line for movement of said upper portion with regard to said lower portion, said upper portion extending downwardly from said separation line and along a rear surface of said lower portions, a tongue of the upper portion removably securing the upper portion to the lower portion, and a rear surface of said upper portion and said lower portion including indicia with the indicia on the rear surface of the upper portion being inverted compared to the indicia on the rear surface of the lower portion, said indicia including information pertaining to the medicine contained in the plastic blister, said indicia on said rear surface being legible when said upper portion is pivoted away from said lower portion with the rear surface facing a customer.

2. The display card for displaying product on a hanging support as claimed in claim 1, wherein said separation line is a fold line.

3. The display card for displaying product on a hanging support as claimed in claim 1, wherein said separation line is a perforated line.

4. The display card for displaying product on a hanging support as claimed in claim 1, wherein said upper portion includes a hanging opening and said lower portion includes a hanging opening, said hanging opening of said upper portion is in alignment with said hanging opening of said lower portion when said upper portion is folded downwardly along said rear surface of said lower portion.

5. The display card for displaying product on a hanging support as claimed in claim 1, wherein said upper portion and said lower portion together form a rectangular shaped piece of cardboard.

6. The display card for displaying product on a hanging support as claimed in claim 1, wherein the lower portion includes a slot for receipt of the tongue.

* * * * *